US006062896A

United States Patent [19]

Huang

[11] Patent Number: 6,062,896

[45] Date of Patent: May 16, 2000

[54] METHOD FOR TERMINATING CONDUCTORS

[75] Inventor: Wayne Huang, Alhambra, Calif.

[73] Assignee: Hon Hai Precision Ind. Co., Ltd., Taipei Hsien, Taiwan

[21] Appl. No.: 09/191,366

[22] Filed: Nov. 13, 1998

[51] Int. Cl.[7] ..... H01R 4/24

[52] U.S. Cl. ..... 439/405; 439/417

[58] Field of Search ..... 439/405, 404, 439/417–419

[56] References Cited

U.S. PATENT DOCUMENTS

| | | | |
|---|---|---|---|
| 4,917,629 | 4/1990 | Matsuzaki et al. | 439/405 |
| 5,118,310 | 6/1992 | Stroede et al. | 439/405 |
| 5,123,859 | 6/1992 | Davis et al. | 439/405 |
| 5,338,221 | 8/1994 | Bowen et al. | 439/405 |
| 5,464,352 | 11/1995 | Van Emmerick | 439/417 |
| 5,597,321 | 1/1997 | Jacques | 439/417 |
| 5,766,033 | 6/1998 | Davis | 439/405 |

*Primary Examiner*—Gary F. Paumen
*Attorney, Agent, or Firm*—Wei Te Chung

[57] ABSTRACT

A method for terminating conductors of conductive wires to insulation displacement sections of a housing of a connector comprises the following steps. Step a) providing a carrier having retaining means. Step b) assembling the conductive wires to the retaining means such that the conductive wires are securely retained therein. Step c) attaching the carrier to the housing whereby insulative layers of the conductive wires abut against the insulation displacement sections. Step d) depressing the carrier toward the housing whereby the conductors are terminated with the insulation displacement sections.

2 Claims, 9 Drawing Sheets

METHOD FOR TERMINATING CONDUCTORS

FIELD OF THE INVENTION

The present invention relates to a method for terminating conductors to insulation displacement sections of terminals by means of a carrier.

DESCRIPTION OF THE PRIOR ART

An IDC connector includes a dielectric housing having a mating face on which a plurality of termination sections are provided. Each termination section includes a pair of parallel, axially spaced plate sections defining a retaining groove therebetween. The termination sections are of the type known as insulation displacement section and arranged transverse to the path of conductors of a flat cable. The IDC connector includes a cover assembled to the mating face. Terminations between the conductors of the ribbon cable and the insulation displacement sections are facilitated as follow.

Generally, the cover is assembled to the housing while a slot for the flat cable is defined therebetween. After the flat cable is manually inserted into the slot, the cover is moved down by an air press whereby edges of the plate sections pierce an insulation layer of the conductor while the conductor is retained within the retaining slot and electrical contact is established therebetween. When the assembly is facilitated automatically, the cover, flat cable and housing are firstly aligned then the cover is directly latched to the housing by the air press to make the termination.

When the pitch of the pin of the connector is small, the insulation displacement sections can be enlarged and strengthened whereby termination can be effectively attained. Nevertheless, when the pitch becomes smaller, for example a 0.8 mm 68-pin ultra SCSI, the insulation displacement sections are too small to withstand improper termination. In both manual and automatic assembly, the conductor is "bumped" to the corresponding insulation displacement section by the cover. The enlarged and strengthened insulation displacement section can withstand the impact from the conductor and make the termination. A mall insulation displacement section without any support becomes vulnerable to the impact from the conductor. If the insulation displacement section can not withstand the impact from the bumped conductor, a beam-type plate thereof will be shifted from its original position. This will cause an incomplete termination or even a short circuit with an adjacent insulation displacement section. In a typical ultra SCSI connector, there are sixty-eight (68) terminations and a single failure will render the connector defective.

In a flat cable, each conductor is connected with the adjacent conductor by the insulation layer. However in cable harness, conductive wires are separated from each other and a termination between a conductive wire and the corresponding insulation displacement section must be done one by one. U.S. Pat. No. 5,766,033 (hereinafter referred to '033) issued to Davis on Jun. 16, 1998 discloses an electrical connector having insulation displacement sections on a common side. The termination between the conductive wire and the insulation displacement section is facilitated by a custom machine, Offset Champomator Model No. 662300-1, available from The Whitaker Corporation. By utilizing the machine, two conductive wires are terminated to lower and upper insulation displacement sections of lower and upper tiers, respectively. For a 68-pin ultra SCSI. the machine must operate 34 times to complete the terminations.

The width of the retaining groove must be accurately defined. If the width does not match the diameter of the conductor of the conductive wire, the conductive wire will become misaligned therewith during assembly of other conductive wires or during a post insert molding process. According to Davis' patent, lower and upper covers (26, 28) are assembled to lower and upper tiers respectively. However. even though wire faces (140) of the covers (26, 28) define grooves (142) therealong for disposing the conductive wires therein, the conductive wires are not retained in the grooves (142). Please refer to column 4, lines 23 to 55 of '033 for details.

SUMMARY OF THE INVENTION

An objective of this invention is to provide a method for terminating conductors of conductive wires and insulation displacement sections by means of a carrier on which the conductive wires are securely retained.

Another objective of this invention is to provide a method wherein the insulation displacement sections are securely supported during termination.

In order to achieve the objectives set forth, a method for terminating conductors of conductive wires to insulation displacement sections of a housing of a connector comprises the following steps. Step a) providing a carrier having retaining means. Step b) assembling the conductive wires to the retaining means such that the conductive wires are securely retained therein. Step c) attaching the carrier to the housing whereby insulative layers of the conductive wires abut against the insulation displacement sections. Step d) depressing the carrier toward the housing whereby the conductors are terminated with the insulation displacement sections.

According to one aspect of the present invention, said carrier comprises guiding means for facilitating engagement with said insulation displacement sections.

A carrier for terminating conductors of conductive wires to insulation displacement sections of a housing of a connector by assembling the carrier to the housing, comprises an elongate base having upper and lower faces. A row of first tabs extends from the lower face and defining a first retaining slot between adjacent tabs. A row of guiding tabs extending from the lower face and is arranged parallel to the row of first tabs. A guiding slot is defined between adjacent guiding tabs. A first guiding slit is defined between ends of the first tabs and the guiding tabs.

An IDC connector in accordance with the present invention comprises a dielectric housing having mating and rear faces. A plurality of terminals extend therethrough. Each terminal has a front contact section at the mating face and an insulation displacement section at a rearward end thereof. The insulation displacement sections define a termination face for terminating conductive wires. A carrier is assembled to the housing for terminating conductors of conductive wires to the insulation displacement sections. The carrier includes retaining means for securely retaining the conductive wires therein.

These and additional objects, features, and advantages of the present invention will become apparent after reading the following detailed description of the preferred embodiment of the invention taken in conjunction with the appended drawings.

DETAILED DESCRIPTION OF THE PREFERRED EMBODIMENT

Figure 1A:
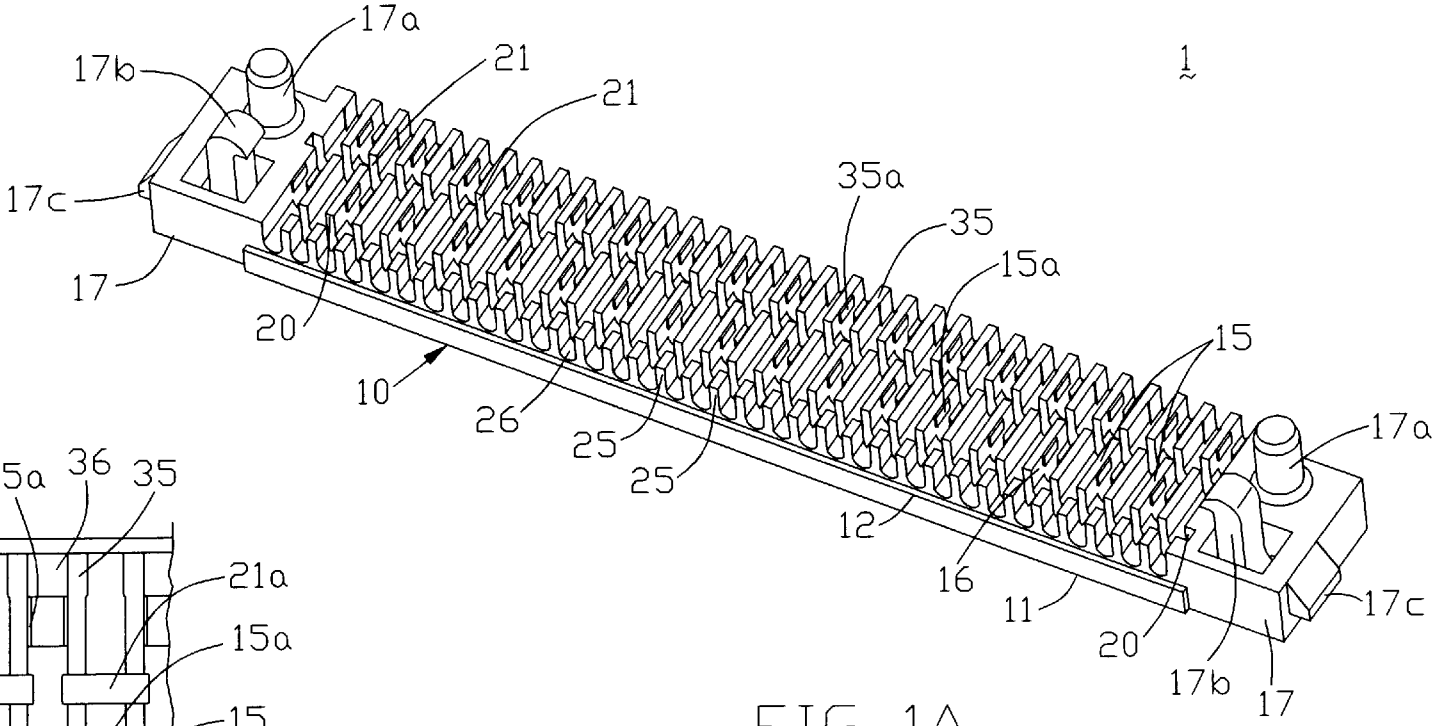
FIG. 1A is a perspective, bottom view of a carrier in accordance with the present invention.
Figure 1B:
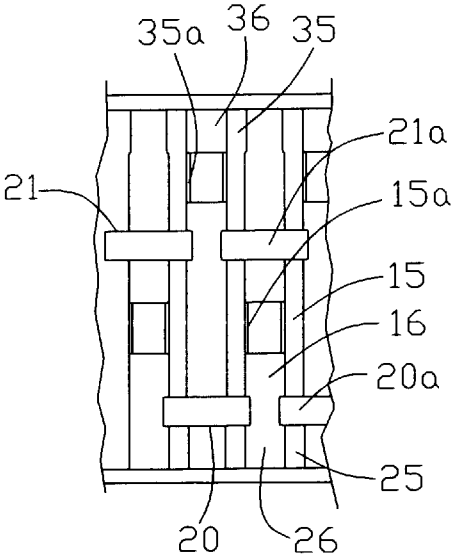
FIG. 1B is a top plan view of a portion of the carrier of FIG. 1.
Figure 2:
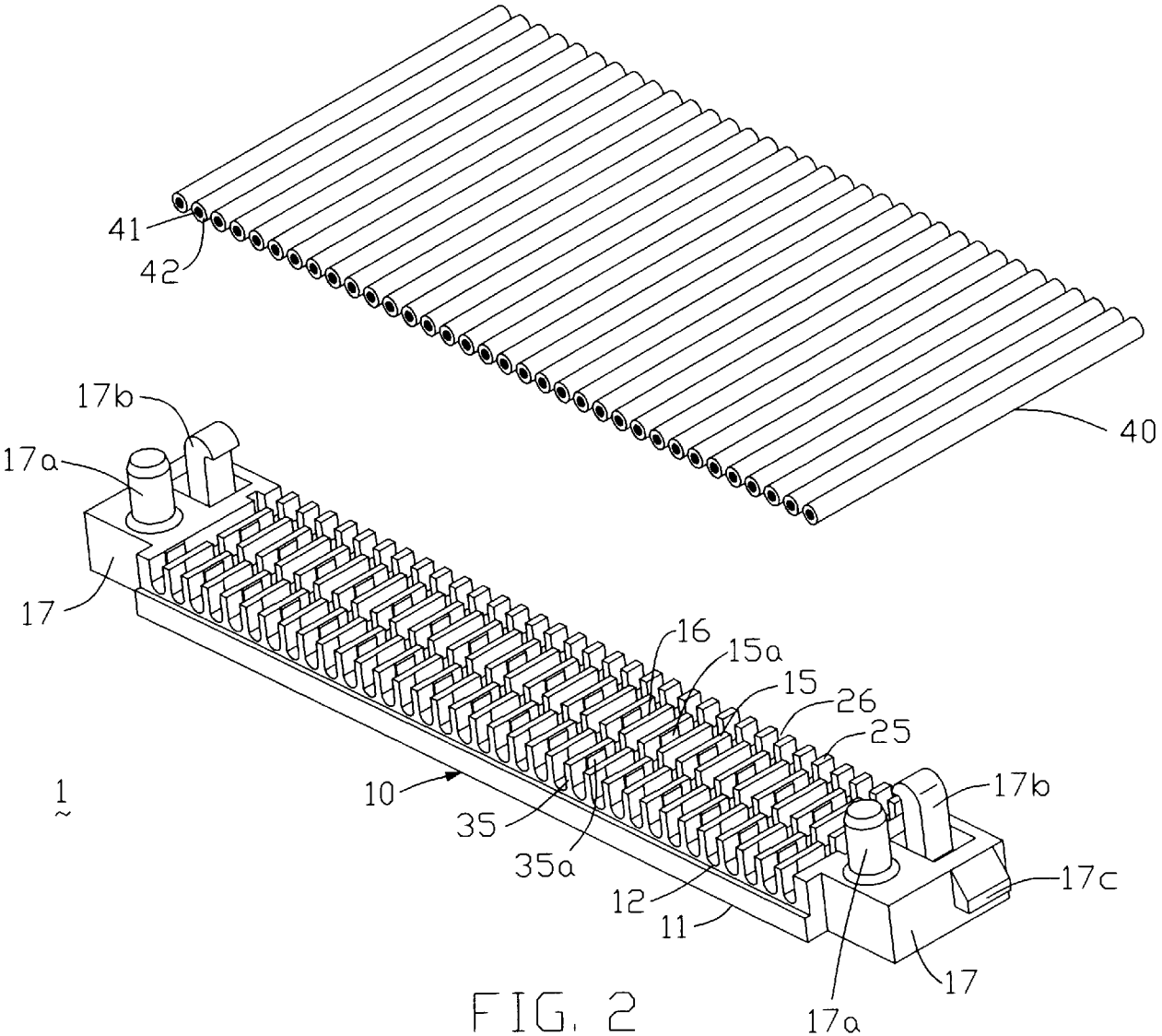
FIG. 2 is similar to FIG. 1A showing a plurality of conductive wires before assembly.
Figure 3A:
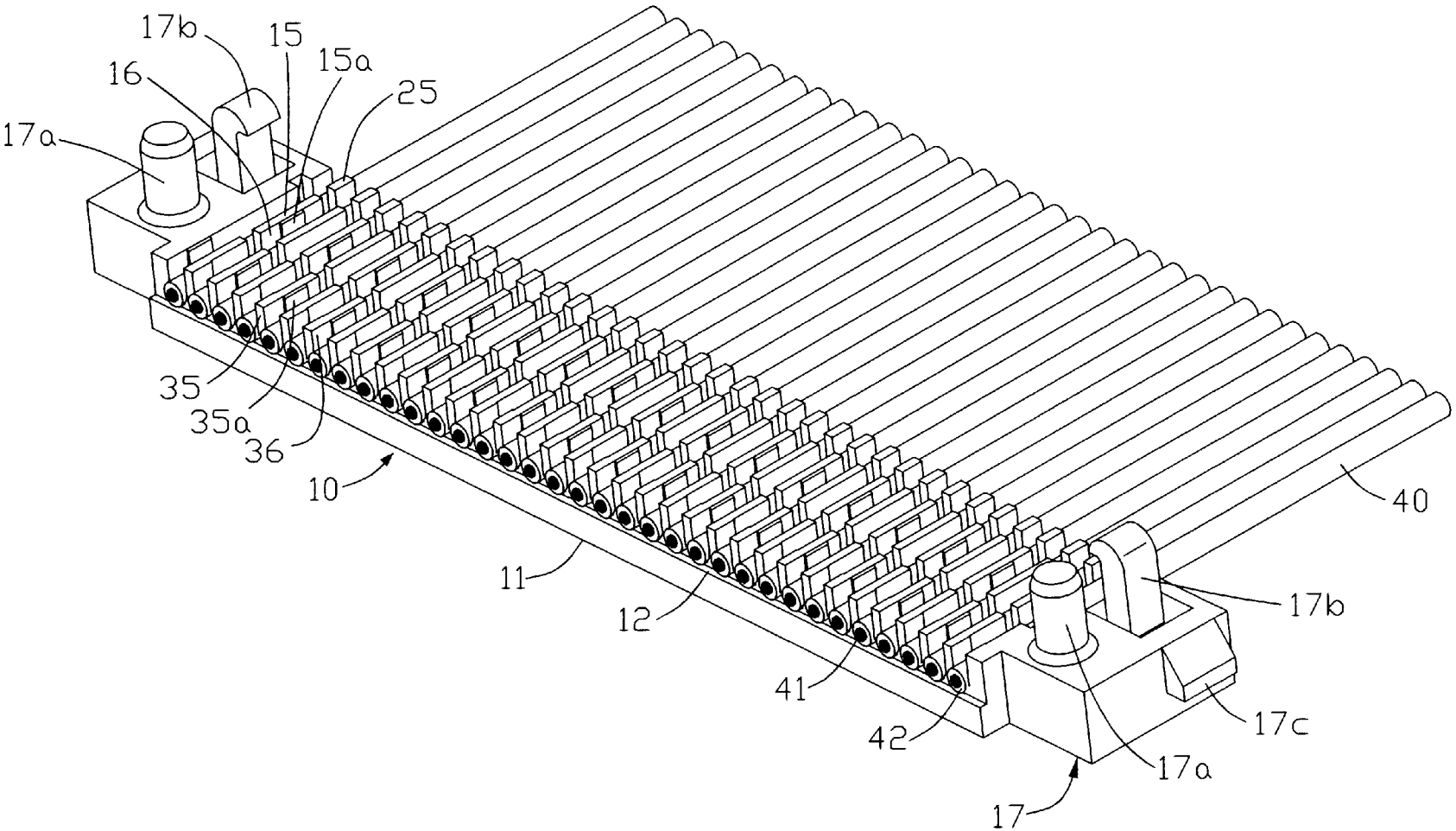
FIG. 3A is similar to FIG. 2 with the conductive wires assembled to the carrier.
Figure 3B:
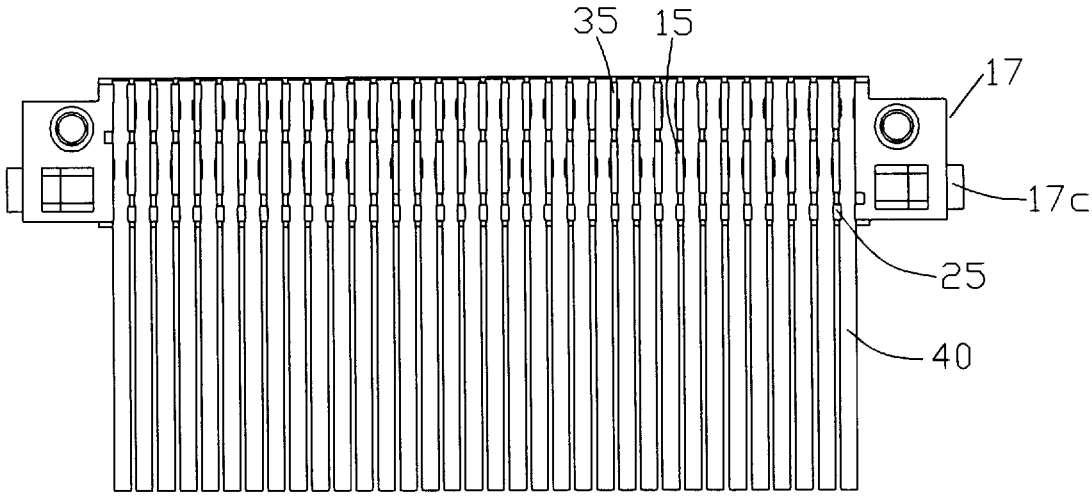
FIG. 3B is a top view of FIG. 3A.
Figure 3C:
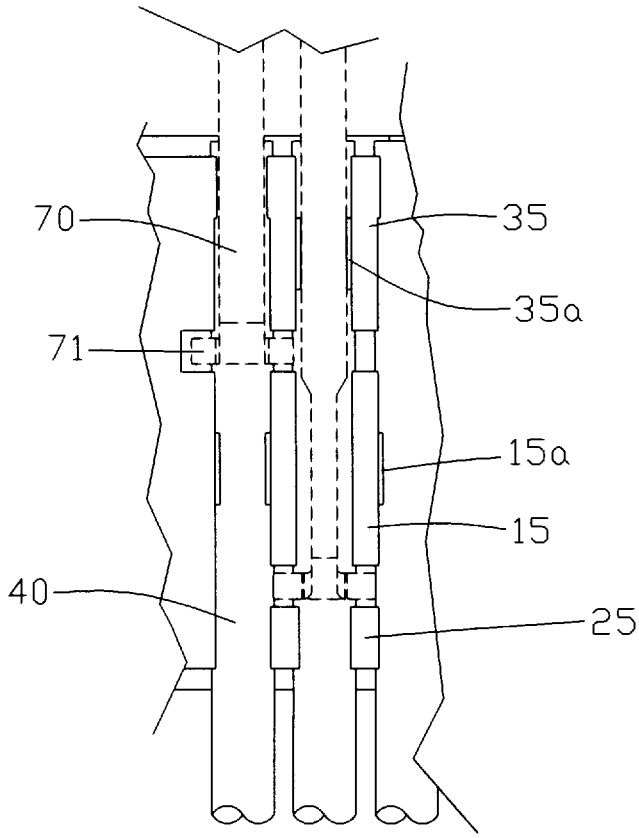
FIG. 3C is an enlarged view of a portion of FIG. 3B.

Referring to FIGS. 1A, 1B, 2, 3A, 3B, 3C and 4, a carrier 1 in accordance with the present invention includes a base 10 having upper and lower faces 11, 12 with the lower face 12 facing upward for facilitating description. A row of first tabs 15 extends from the lower face 12 and defines a first retaining slot 16 between adjacent first tabs 15. Inner walls of the first retaining slot 16 form projections 15*a* thereon which reduce a width of the first retaining slot 16. The first retaining slot 16 has a round bottom (not labeled) for mating with an outer periphery of a conductive wire 40. A row of guiding tabs 25 extends from the lower face 12 and is arranged parallel to the row of first tabs 15. A guiding slot 26 is defined between adjacent guiding tabs 25. Each guiding slot 26 is aligned with the corresponding first retaining slot 16. The guiding slot 26 also has a round bottom for mating with the conductive wire 40. A first guiding slit 20 is defined between ends of the first tabs 15 and the guiding tabs 25.

The first retaining and guiding slots 16, 26 are dimensioned to mate with the corresponding conductive wire 40 whereby the conductive wire 40 can be snugly seated therein. Each conductive wire 40 includes a conductor 41 coated with an insulation layer 42. The carrier 1 includes a row of second tabs 35 extending from the lower face 12. A second retaining slot 36 is defined between adjacent tabs 35. Inner walls of the second retaining slot 36 form projections 35*a* which reduce a width of the second retaining slot 36. The second retaining slot 36 has a round bottom (not labeled) for mating with an outer periphery of the conductive wire 40. The second retaining slot 36 is aligned with the guiding slot 26.

A mounting block 17 extends from each lateral end of the base 10. A guiding post 17*a* and a hook 17*b* are integrally formed on a lower face thereof. The guiding post 17*a* can be snugly received in a guiding hole 51 defined in a housing 50 while the hook 17*b* engages with a wedge 52, including upper and lower wedges 52*a*, 52*b* at first and second stages, respectively, formed on the housing 50. The mounting block 17 further includes a trapezoidal wedge 17*c* which engages with an EMI bracket (not shown). A second guiding slit 21 is defined between ends of the first and second tabs 15, 35. The first and second guiding slits 20, 21 receive insulation displacement sections 71 of terminals.

Figure 8B:
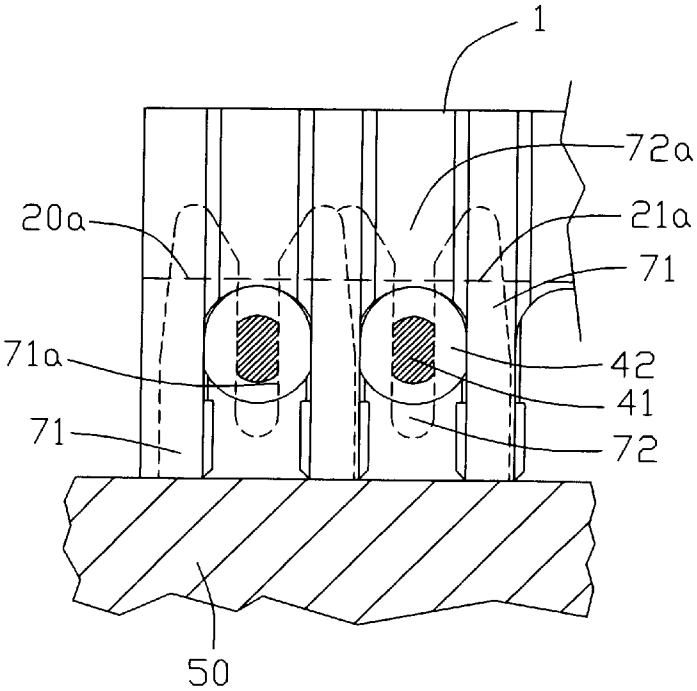
FIG. 8B is a front view showing the carrier and the insulation displacement sections at the second stage.
Figure 8A:
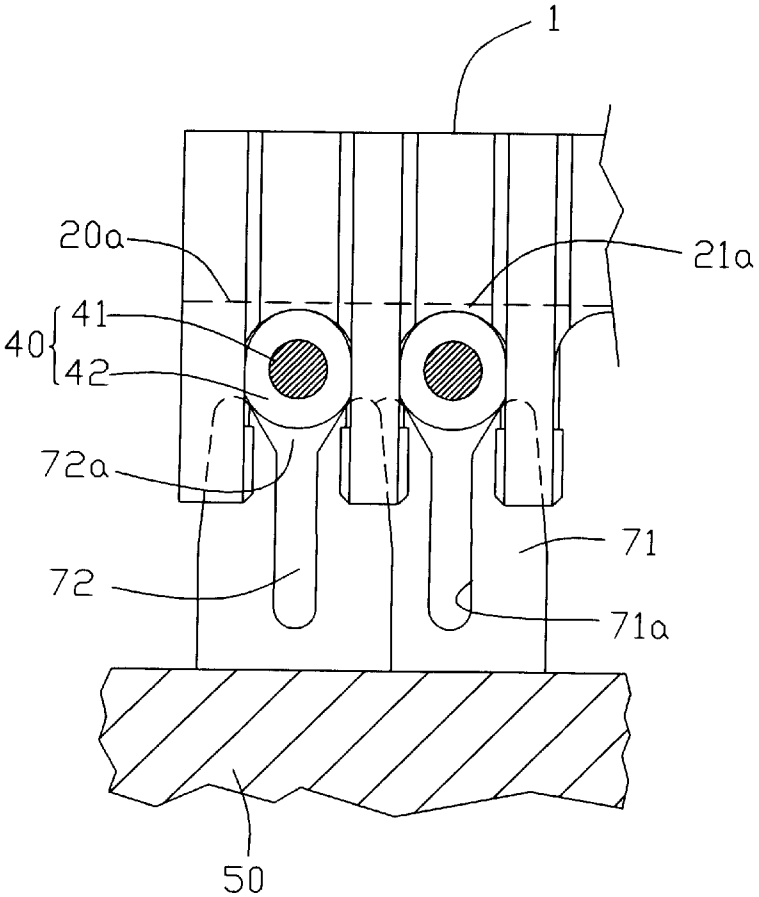
FIG. 8A is a front view showing the carrier and the insulation displacement sections at the first stage.

In addition, an array of channels 20*a*, 21*a* is defined through the base 10. Each channel 20*a* (21*a*) intersects with the corresponding retaining slot 36 (16) whereby when the insulation displacement section 71 cuts through the insulation 42 of the conductive wire 40, tips of the insulation displacement section 71 extend into the channel 20*a* (21*a*) (FIG. 8B).

In this embodiment, the base 10 of the carrier 1 forms the first tabs 15, the guiding tabs 25, and the second tabs 35 and defines the first retaining slots 16. the guiding slots 26, and the second retaining slots 36. The guiding slits 20, 21 separate the tabs into the first tabs 15, the guiding tabs 25 and the second tabs 35. The channels 20*a*, 21*a* are defined through the base 10 from the guiding slits 20, 21.

Figure 4:
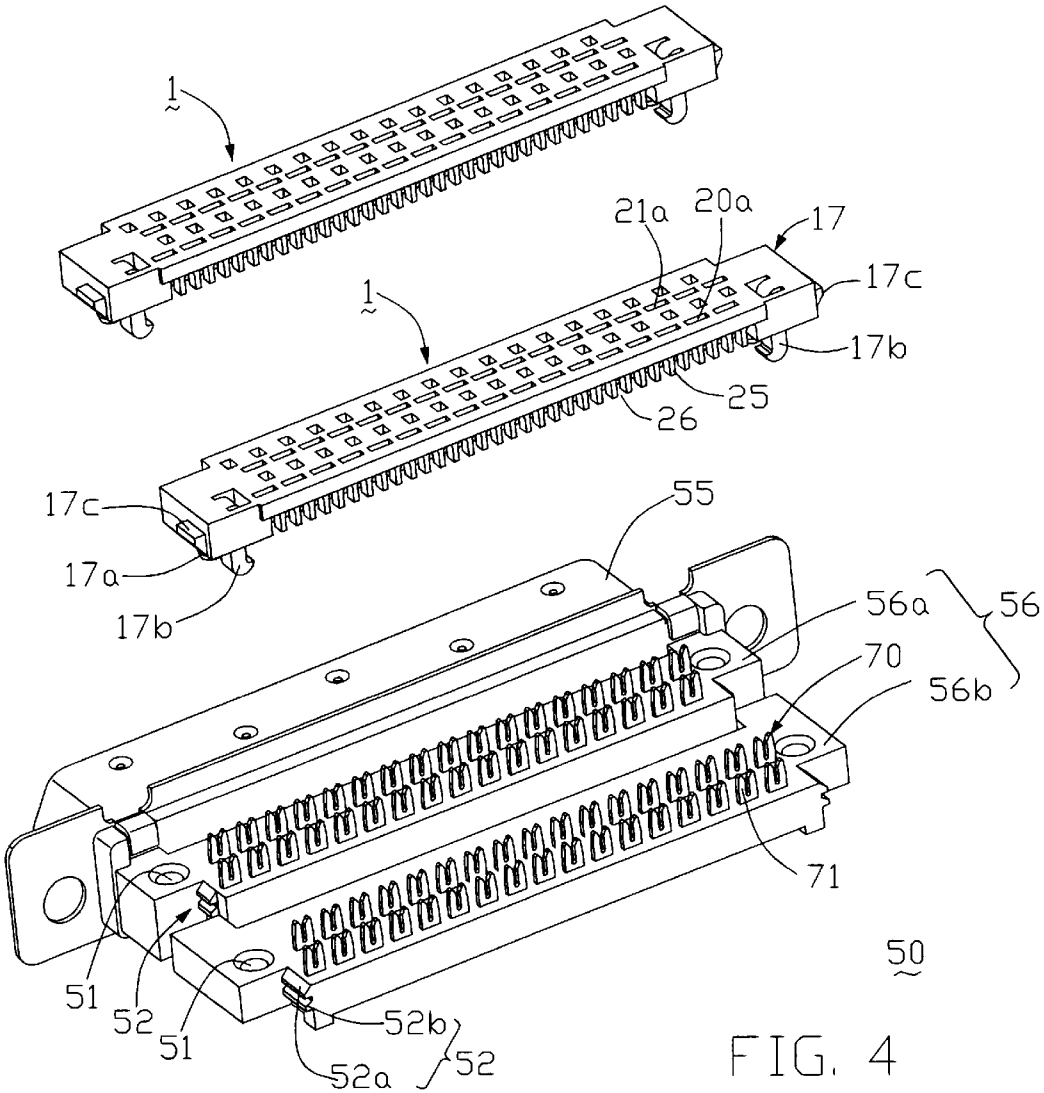
FIG. 4 is an exploded view of a connector in accordance with the present invention.
Figure 5:
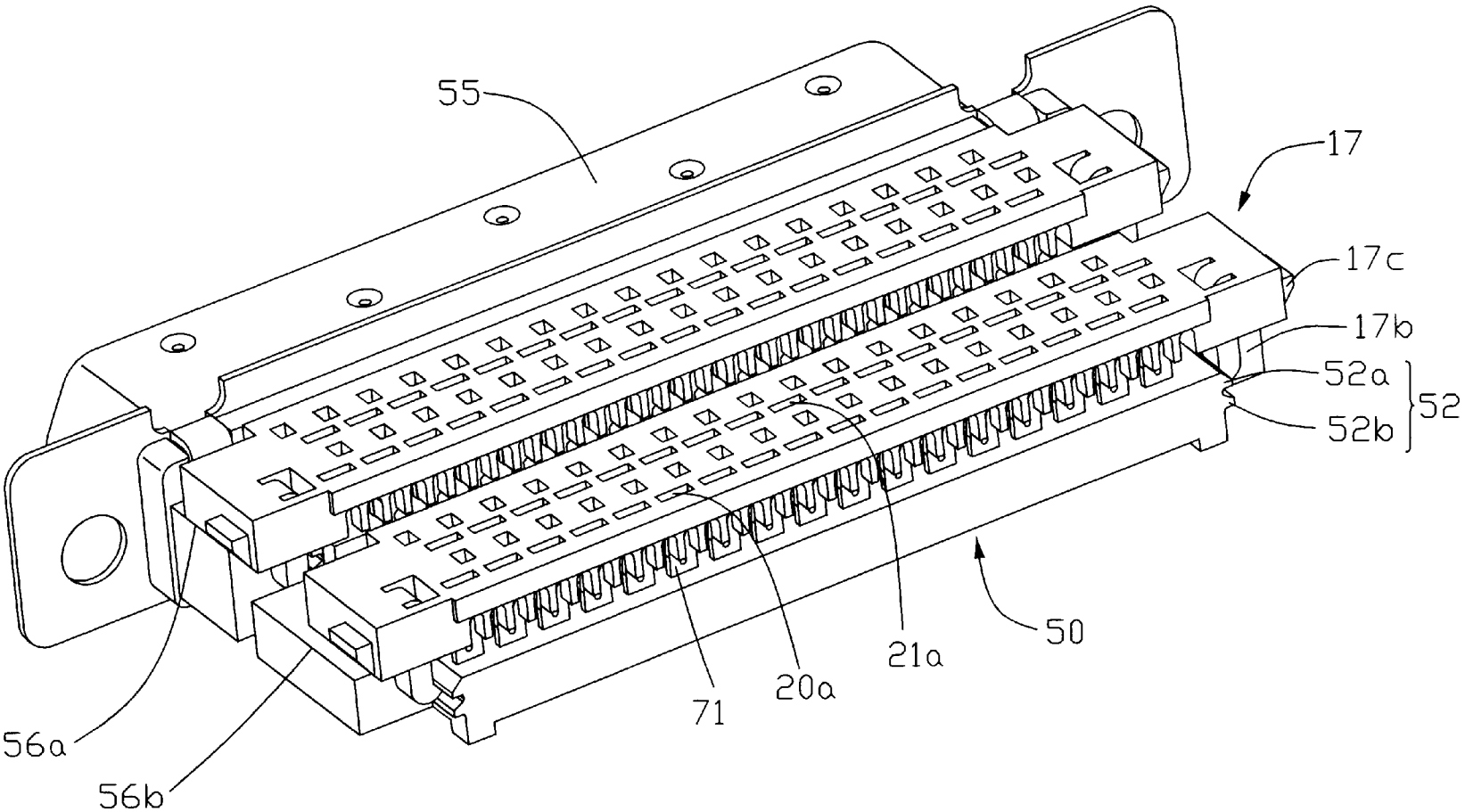
FIG. 5 is an assembled view of FIG. 4.
Figure 6A:
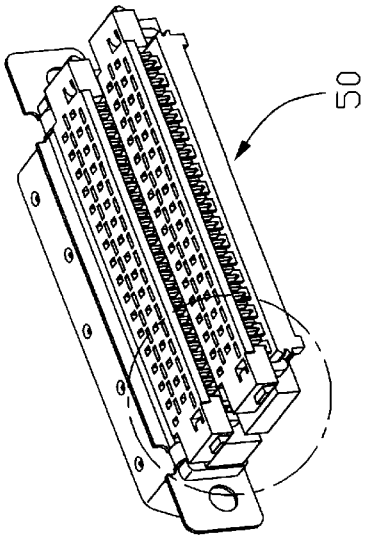
FIG. 6A is similar to FIG. 5 with a first carrier located at a first stage and a second carrier located at a second stage.
Figure 6B:
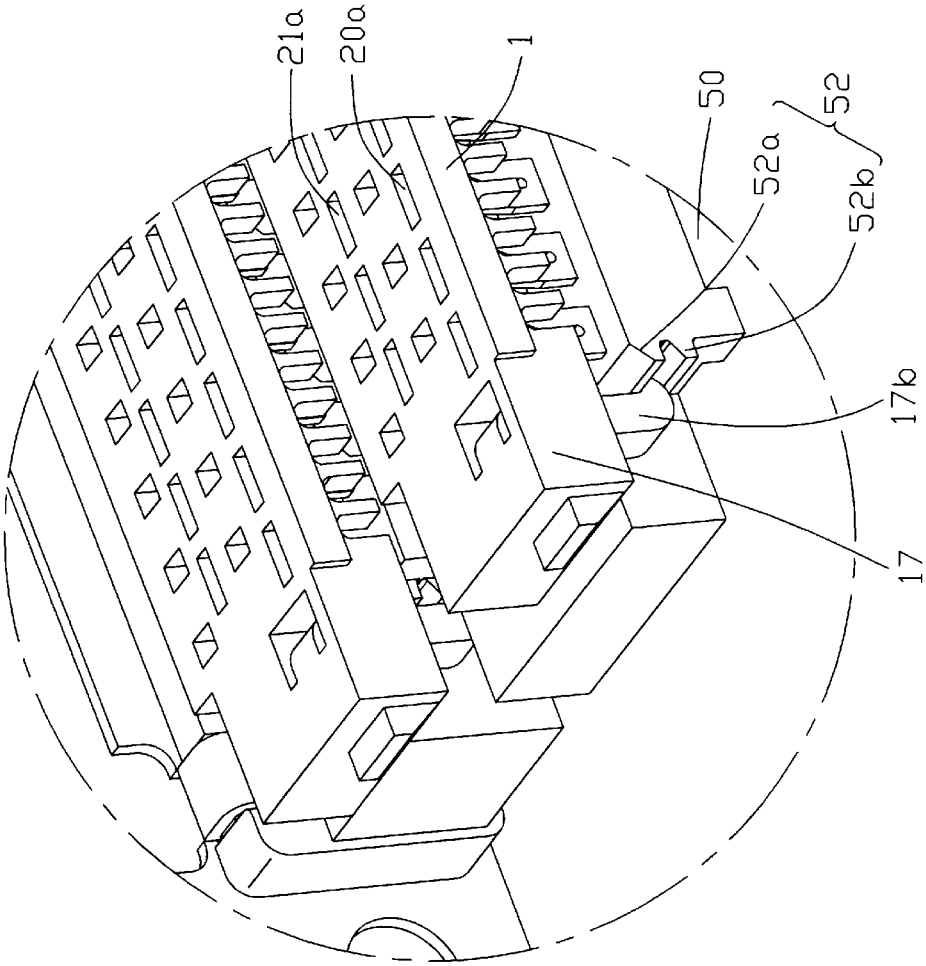
FIG. 6B is a enlarged view of an encircled portion of FIG. 6A.
Figure 7:
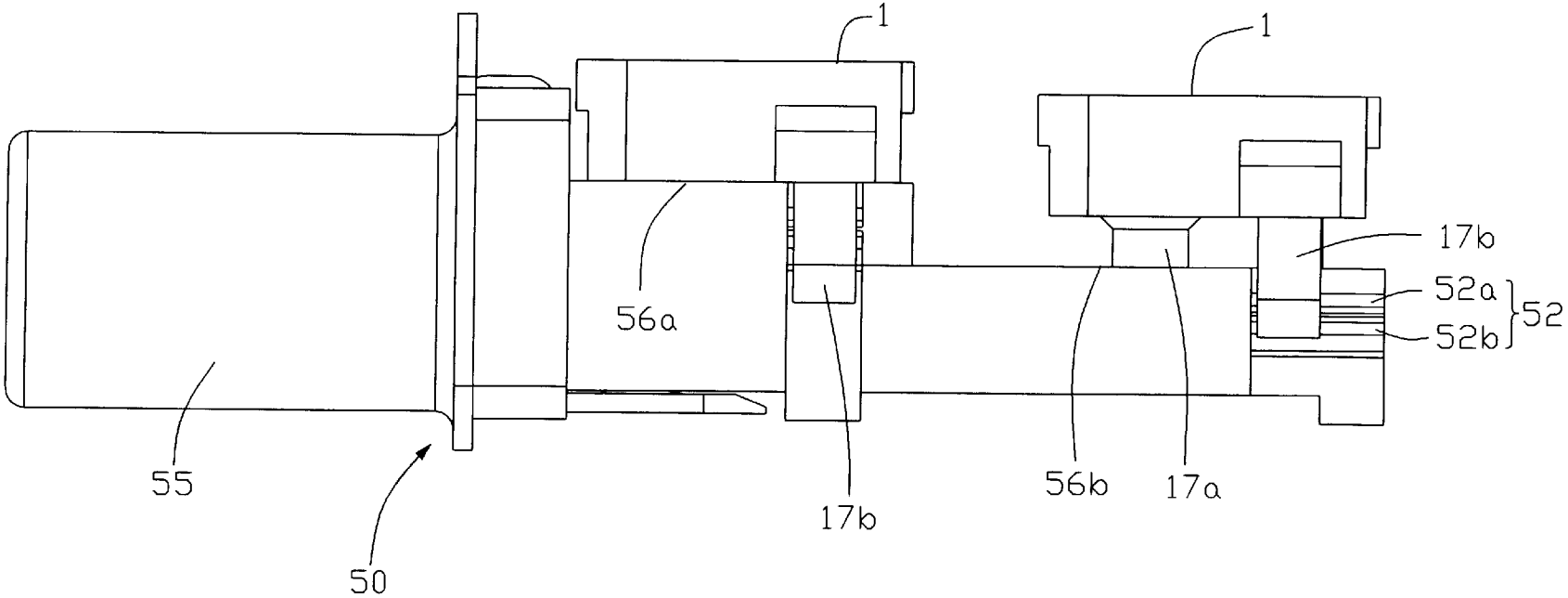
FIG. 7 is a side elevational view of FIG. 6A.

Still referring to FIG. 4, the housing 50 includes a front mating portion 55 for mating with a complementary connector (not shown) and a rear termination portion 56 for terminating with the conductive wires 40. The termination portion 56 includes a first tier 56*a* and a second tier 56*b* located in different levels. A plurality of terminals 70 are embedded into the housing 50 with the termination displacement section 71 extending upward therefrom. The termination of the conductive wires 40 with the insulation displacement sections 71 is facilitated by the carrier 1.

Referring to FIGS. 5, 6A, 6B, 7, 8A and 8B, before the conductive wires 40 are terminated to the insulation displacement sections 71, the conductive wires 40 are selectively assembled to the carrier 1 according to printed color codes. Each carrier 1 has thirty-four retaining slots 16, 36 for assembling thirty-six conductive wires 40 therein. The carrier 1 is then assembled to the tiers 56 in two different stages. The guiding post 17*b* of the carrier 1 is aligned with the guiding hole 51 of the tiers 56 and guided thereby while receiving a downward force whereby the hook 17*a* of the carrier 1 engages with the upper wedge 52*a* of the housing 50. At the first stage, the insulation displacement sections 71 are received within the guiding slits 20, 21 while the insulation layer 42 of the conductive wire 40 is located at a flared entrance 72*a* of a slot 72 defined in the insulation displacement section 71. A further downward force exerted on the upper face 11 of the carrier 1 results in the conductive wires 40 being moved downward into the slot 72 of the insulation displacement section 71. During the downward movement of the carrier 1 the insulation layer 42 of the conductive wire 40 is pierced by inner blades 71*a* of the insulation displacement section 71 thereby establishing an electrical connection therebetween. Since the insulation displacement sections 71 are guided by the guiding slits 20, 21 and the channels 20*a*, 21*a*, the terminations between the insulation displacement sections 71 and the conductors 41 of the conductive wires 40 can be effectively performed. If the insulation displacement section 71 moves during the termination process, the support thereof by inner walls of the guiding slits 20, 21 assures effective terminations.

It is noted that in comparison with the prior art which needs to have the conductive wires one by one respectively engaged with the corresponding terminals through insulation displacement sections by several individual pressing actions, the invention provides a carrier adapted to carry all the conductive wires at one time to approach the corresponding insulation displacement sections of the terminals, and further have all the conductive wires simultaneously engaged with the insulation displacement sections of the terminals by only one pressing operation.

It is also contemplated that the prior arts generally put the conductive wires on the corresponding insulation displacement sections of the terminals and directly press the wires downward to have the insulation displacement sections of the terminals pierce into the conductors of the conductive wires, wherein the conductive wires and the corresponding insulation displacement sections of the terminals all lack sufficient support to maintain themselves in assured relative positions, thus tending to result in defective insulation displacement contact therebetween due to possible tilting of either of them during pressing. In contrast, in the invention, the conductive wires and the insulation displacement sections of the terminals can be first reliably retained in relative positions by the carrier at the first stage, and then under that situation, the pressing forces are applied thereto at the second stage. Therefore, the insulation displacement contact between the conductive wires and the insulation displacement sections of the terminals can be expected to be in a good status. It should be understood that the key arrangement for this implementation is to set the depth of the retaining slot is large enough to accommodate the individual conductive wire therein so that when the individual independent conductive wire is sandwiched between the retaining slot and the insulation displacement section of the corresponding terminal, the tip of the insulation displacement section of the terminal can be first engaged within the guiding slit before the insulation displacement section of the terminal starts piercing into the conductive wire.

It is also appreciated that the subject IDC connector is substantially of an intermediate product which cooperating with the assembled conductive wires, is adapted to further be molded to form a complete cable connector assembly.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A carrier for terminating conductors of conductive wires to insulation displacement sections of terminals positioned in a housing of a connector by assembling said carrier to said housing, said carrier comprising:

an elongate base having upper and lower faces;

a row of first tabs extending from said lower face and defining a first retaining slot between every two adjacent first tabs;

a row of guiding tabs extending from said lower face, arranged parallel to said row of first tabs and defining a guiding slot between every two adjacent guiding tabs; and a first guiding slit defined between two aligned pairs of said first tabs and said guiding tabs;

further comprising a row of second tabs extending from said lower face and defining a second retaining slot between every two adjacent second tabs;

wherein inner walls of said first retaining slots form projections;

wherein said guiding slot aligns with said first retaining slot;

wherein a second guiding slit is defined between ends of said first and second tabs.

2. An IDC connector, comprising:

a dielectric housing having a plurality of terminals therein, said terminals having insulation displacement sections for respectively terminating conductive wires; and a carrier assembled to said housing for terminating conductors of said conductive wires to said insulation displacement sections, said carrier including a retaining device for securely retaining said conductive wires thereto before the conductors have been terminated by the corresponding insulation displacement sections of the terminals, wherein the conductive wires are sandwiched between the terminals and the carrier;

wherein said retaining device comprises slots defined transversely along a lower face thereof for retainably receiving corresponding conductive wires therein, respectively;

wherein said carrier further comprises guiding means for facilitating engagement with said insulation displacement sections;

wherein termination between said conductors and said insulation displacement sections is facilitated by a first stage at which insulation layers of said conductive wires abut against said insulation displacement sections, and a second stage at which said insulation layers of the conductive wires are pierced by said insulation displacement sections;

wherein portions of said insulation displacement sections are received within guiding means of the carrier at said first stage for facilitating engagement between the carrier and the insulation displacement sections.

* * * * *